US005485775A

United States Patent [19]

Duke et al.

[11] Patent Number: 5,485,775

[45] Date of Patent: Jan. 23, 1996

[54] GUN GAS CONTROL SYSTEM FOR MULTI-BARREL WEAPONS

[75] Inventors: Steven R. Duke, Williston; Glenn E. Rossier, Ferrisburg; Richard P. Saganich, Cambridge, all of Vt.

[73] Assignee: The United States of America as represented by the Secretary of the Air Force, Washington, D.C.

[21] Appl. No.: 357,699

[22] Filed: Dec. 16, 1994

[51] Int. Cl.[6] ..... F41A 21/36

[52] U.S. Cl. ..... 89/14.3; 89/12

[58] Field of Search ..... 89/9, 11, 12, 13.05, 89/13.1, 14.3, 1.12

[56] References Cited

U.S. PATENT DOCUMENTS

| | | | |
|---|---|---|---|
| 2,273,839 | 2/1942 | De Port et al. | 89/14.3 |
| 3,703,122 | 11/1972 | Farrington et al. | 89/14.3 |
| 4,121,496 | 10/1978 | Clayson | 89/37.5 R |
| 4,398,445 | 8/1983 | Ulrich | 89/12 |
| 4,534,265 | 8/1985 | Bates et al. | 89/14.6 |
| 4,574,682 | 3/1986 | Hillman | 89/12 |
| 4,619,182 | 10/1986 | Hellstrom | 89/37.16 |
| 4,656,919 | 4/1987 | Farinacci et al. | 89/14.6 |

FOREIGN PATENT DOCUMENTS

| | | | |
|---|---|---|---|
| 560078 | 9/1993 | European Pat. Off. | 89/14.3 |

OTHER PUBLICATIONS

Gun Gas Control Technology, Contract No. F08635-89-C-0143, Data Item B010—Final Report, vol. 2, Dec. 1991.

*Primary Examiner*—Stephen M. Johnson
*Attorney, Agent, or Firm*—Stanton E. Collier; Jacob N. Erlich

[57] ABSTRACT

The invention consists of four components: a diverter assembly, a blocking plate assembly, a blast deflector and an exhaust duct. The diverter attaches to the gun barrel clamp and rotates and recoils with the gun; as gases leave the gun barrels and enter the diverter they are redirected by it from axial flow to radial and tangential flow, thereby imparting a forward force and a torque to the barrel cluster. The blocking plate assembly does not rotate within the diverter and acts to limit the egress gas and the gas that flows into the non-firing gun barrels. The blast deflector has a collector that surrounds the diverter and collects the diverted gases. The duct receives the collected gases and conducts them to the desired exhaust ports.

5 Claims, 6 Drawing Sheets

GUN GAS CONTROL SYSTEM FOR MULTI-BARREL WEAPONS

STATEMENT OF GOVERNMENT INTEREST

The invention described herein may be manufactured and used by or for the Government for governmental purposes without the payment of any royalty thereon.

BACKGROUND OF THE INVENTION

The present invention relates to multi-barrel guns in fighter aircraft, and, in particular, to controlling the flow of gases from the gun barrels.

The use of high rate of fire guns in aircraft, in particular, multi-barrel gatling type guns which can fire up to 6,000 rounds per minute as used in F-15, create special problems. Gun muzzle gases are the source of many gun/aircraft interface problems. Typical aircraft problems associated with gunfire generated gases include: gun gas induced engine failure, excessive gun/aircraft interface loads, aircraft surface damage, impaired pilot visibility, unacceptable visual and thermal signatures due to secondary flash, and excess gun bay gases causing fire and explosions.

The types of hardware that have been developed in the past for the express purpose of gun gas management are quite diverse, but can be broadly categorized as either muzzle devices, which are attached directly to the gun muzzle, or blast deflectors, which generally attach to structure surrounding the gun muzzle. Muzzle devices are typically employed for one or more of the following reasons: suppression of secondary flash, recoil force reduction, redirection and/or diffusion of the axially flowing muzzle gases, and torque generation to assist rotation of a gatling gun. Some of these characteristics tend to be negatively impacted by other, for example, a flash supressing device cannot usually be designed to also generate torque (the resultant turbulence causes improved air mixing with the hot gases, thereby promoting secondary flash). Blast deflectors are typically rugged metal fabrications that protect more fragile aircraft structure from the muzzle gas heat and pressure, muzzle debris and percussion waves from the passing projectile. They usually partially surround the gun muzzle such that the muzzle gases expand in the direction of the open side. Blast deflectors sometimes provide lateral and vertical support to the gun muzzle, and may contain a gas seal that inhibits rearward flow into the gun compartment. Typical gun installations usually employ some sort of muzzle device or blast deflector, and in some cases, both are used. Examples of the latter are the 20-mm F-4E internal gun system, the 20-mm GPU-2/A gun pod and the 30-mm GPU-5/A gun pod. The GPU-5/A contains a diverter attached to the gun muzzle and a collector that surrounds the diverter and gun muzzle (the collector forms the entire nose of the pod). However, the GPU-5/A diverter is a simple baffle plate design that does not generate torque and is not an efficient recoil reducer. The GPU-5/A also does not employ the duct component, instead gases exhaust directly to the atmosphere through perforations in the lower quadrant of the collector.

Improvements in this area are illustrated by U.S. Pat. Nos. 4,574,682 and 3,703,122. These patents are directed at devices attached to the multi-barrel gun muzzle and assist in providing torque to turn the barrels and reduce the amount of recoil. Although these devices perform as stated, additional control of the gas is needed as it leaves the aircraft as well as further control of the gas as it leaves the gun muzzle.

Thus, there exists a need for a means of preventing many of the problems associated with gatling gun's muzzle gas.

SUMMARY OF THE INVENTION

The present invention provides a means for gas control in multi-barrel gatling guns used in fighter aircraft. This invention alleviates problems associated with muzzle gases from high performance multi-barrel guns. The gas control system captures a substantial majority of the gun muzzle gases as they leave the gun barrels and conducts the diverted gases to more suitable exhaust points. Prior to exhausting them to the atmosphere, the system attenuates the highly transient mass flow rate, temperature and pressure of the gases such that the exhaust plume is more docile, less likely to ignite as secondary flash, and less likely to harm surrounding aircraft structure. Since only a small fraction of the total gun gas exits the aircraft at the projectile egress point, typical blast effects are significantly reduced in this vicinity. The system also extracts useful work from the high energy gases in the form of gun recoil force reduction and gun rotational assistance. The system consists of four components: a diverter, a blocking plate assembly, a collector and a duct. The diverter attaches to the gun barrel cluster and rotates and recoils with the gun; as gases leave the gun barrels and enter the diverter they are redirected by it from axial flow to radial and tangential flow, thereby imparting a forward force and a torque to the barrel cluster. The blocking plate assembly does not rotate within the diverter and acts to limit the egress gas and the gas that flows into the non-firing gun barrels. The collector surrounds the diverter and collects the diverted gases and the duct receives the collected gases and conducts them to the desired exhaust ports.

Therefore, one object of the present invention is to provide a means of gas control for multi-barreled gatling guns.

Another object of the present invention is to provide a system for gas control that achieve s 80% diversion of gun muzzle gas.

Another object of the present invention is to provide a system for gas control that minimizes gas flow down non-firing barrels.

Another object of the present invention is to provide a system for gas control that eliminates secondary gun gas ignition.

Another object of the present invention is to provide a system for gas control that reduces gun recoil by 30%.

Another object of the present invention is to provide a system for gas control that reduces the power requirements for driving the gun.

Another object of the present invention is to provide a system for gas control that fits within the space requirements of a modern fighter aircraft.

These and many other objects and advantages of the present invention will be readily apparent to one skilled in the pertinent art from the following detailed description of a preferred embodiment of the invention and the related drawings.

DETAILED DESCRIPTION OF THE PREFERRED EMBODIMENT

Figure 1:
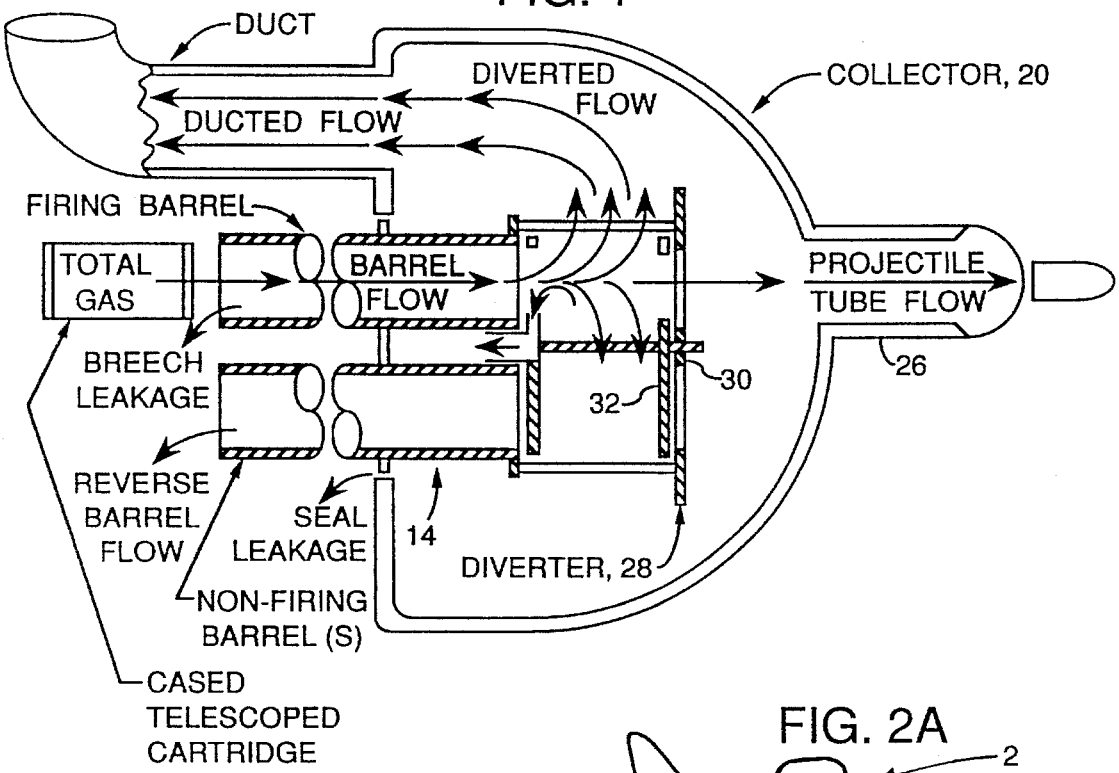
FIG. 1 illustrates the various gas flow paths in the multi-barrel gun.
Figure 2A:
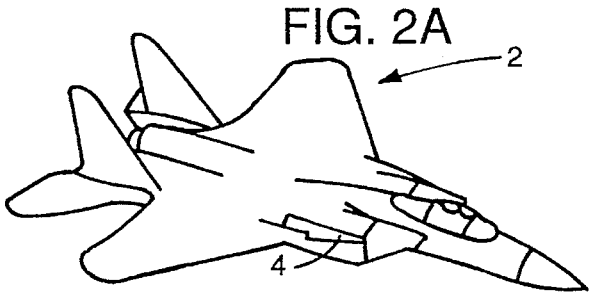
FIGS. 2A and B illustrates the location of the present invention on an aircraft such as the F-15.
Figure 2B:
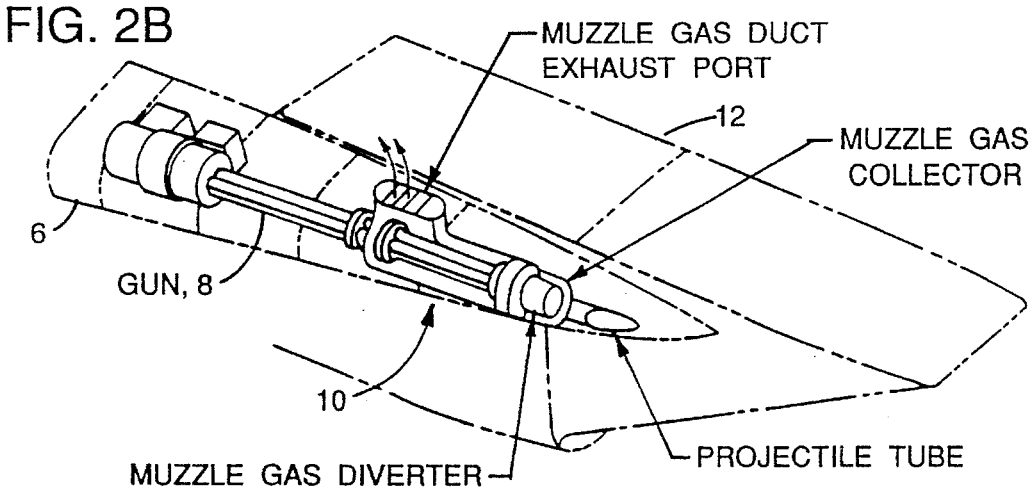
Figure 4:
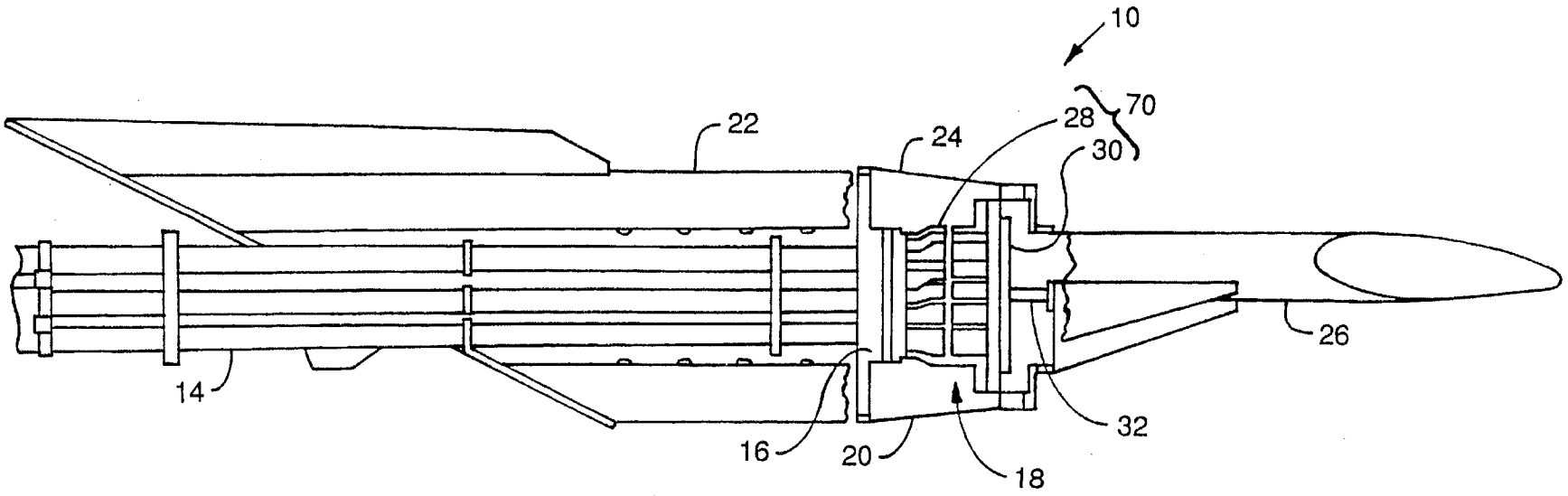
FIG. 4 illustrates a cross sectional view of a partial multi-barrel gun and gas control system of the present invention.

In order to understand the invention, reference is made to FIGS. 1 and 2. In FIG. 2A, a F-15 Eagle fighter 2 is shown having a gun system 4 of the gatling gun type with 5 rotating barrels. Although the invention was directed at the above fighter 2, the features of this invention are adaptable to other multi-barrel gun systems. As seen therein, the gun system 4 is mounted within a fairing 6, FIG. 2B, on the outboard side of one engine intake 12. A gun 8 having 5 rotating barrels has a gas control system 10 attached thereabout. A better view of the gas control system 10 is shown in FIG. 4. The barrels 14 are held by a muzzle clamp 16. Attached to the muzzle clamp is a gas diverter assembly 18 to be further explained hereinbelow. The diverter assembly 18 is in rotating engagement with a gas collector 20. The diverter assembly 18 has a gas diverter 28, a baffle plate 30, and a blocking plate assembly 32, only partially shown, located within the diverter 28. The concept of gas control is best illustrated in FIG. 1. As seen therein, substantially all of the muzzle gas is ducted to the outside rather than exiting through the gas dispersion tube 26 from which the projectiles exit and entering the gun housing by seal leakage and flow down the non-firing barrels. Muzzle gas can exit through a ducted port 22, and a gas dispersion tube 26.

Figure 3:
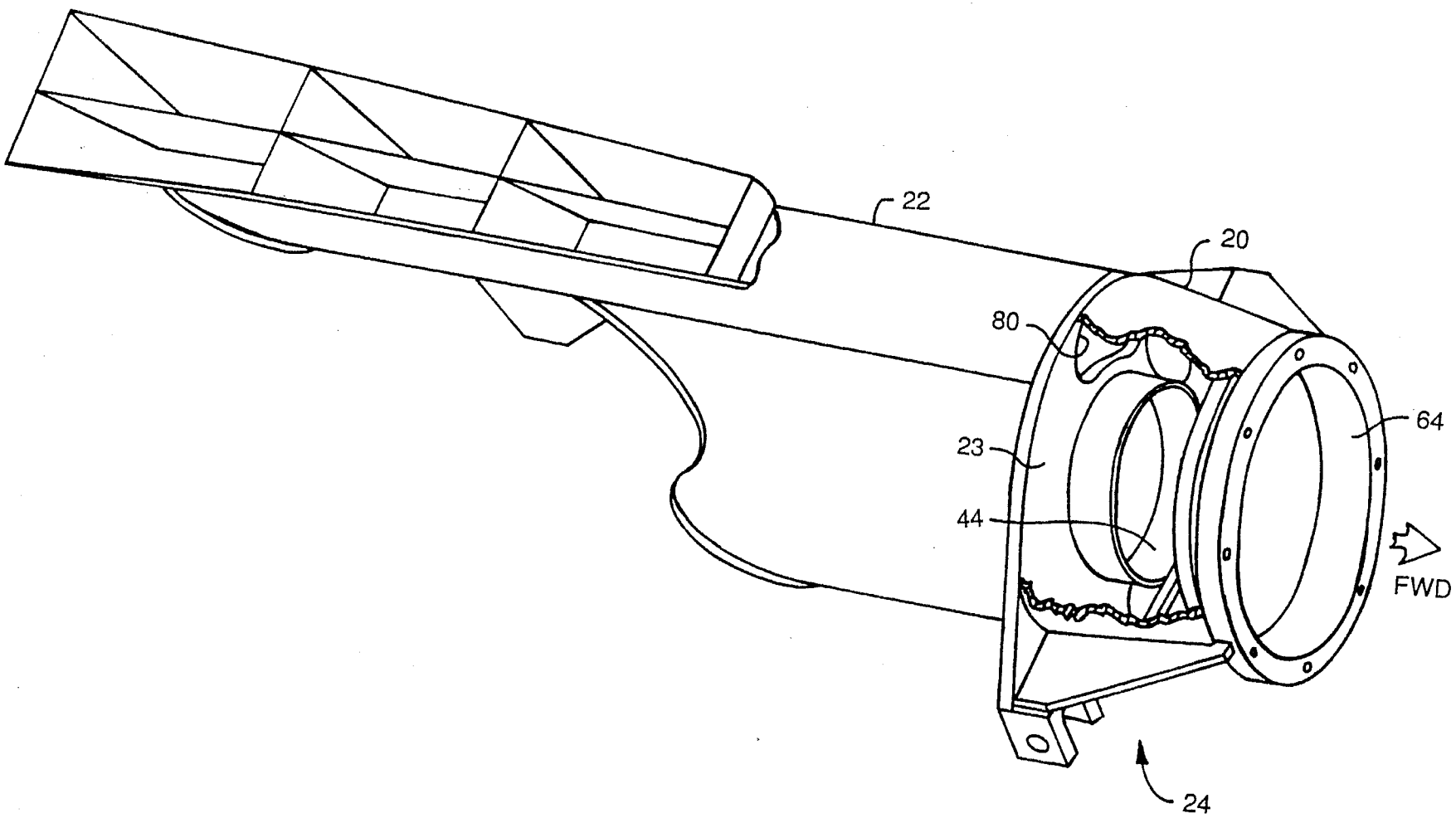
FIG. 3 illustrates by perspective a gas deflector for the gas control system.
Figure 5:
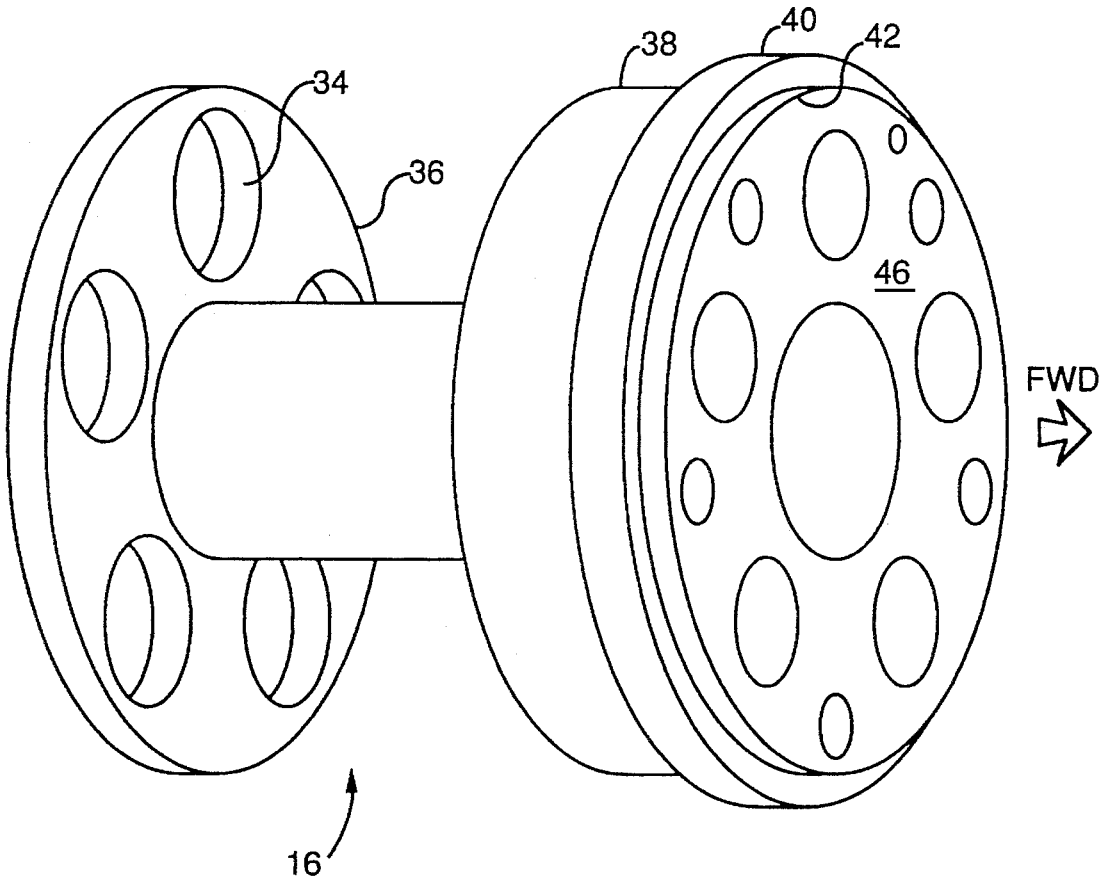
FIG. 5 illustrates by perspective a muzzle clamp.
Figure 6:
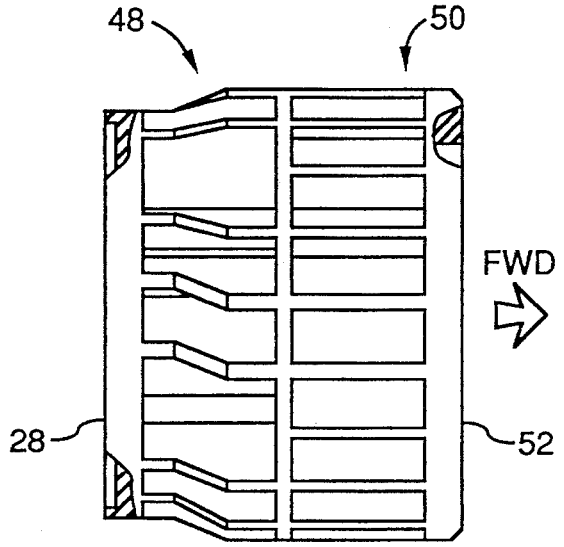
FIG. 6 illustrates a gas diverter from a side view.
Figure 7:
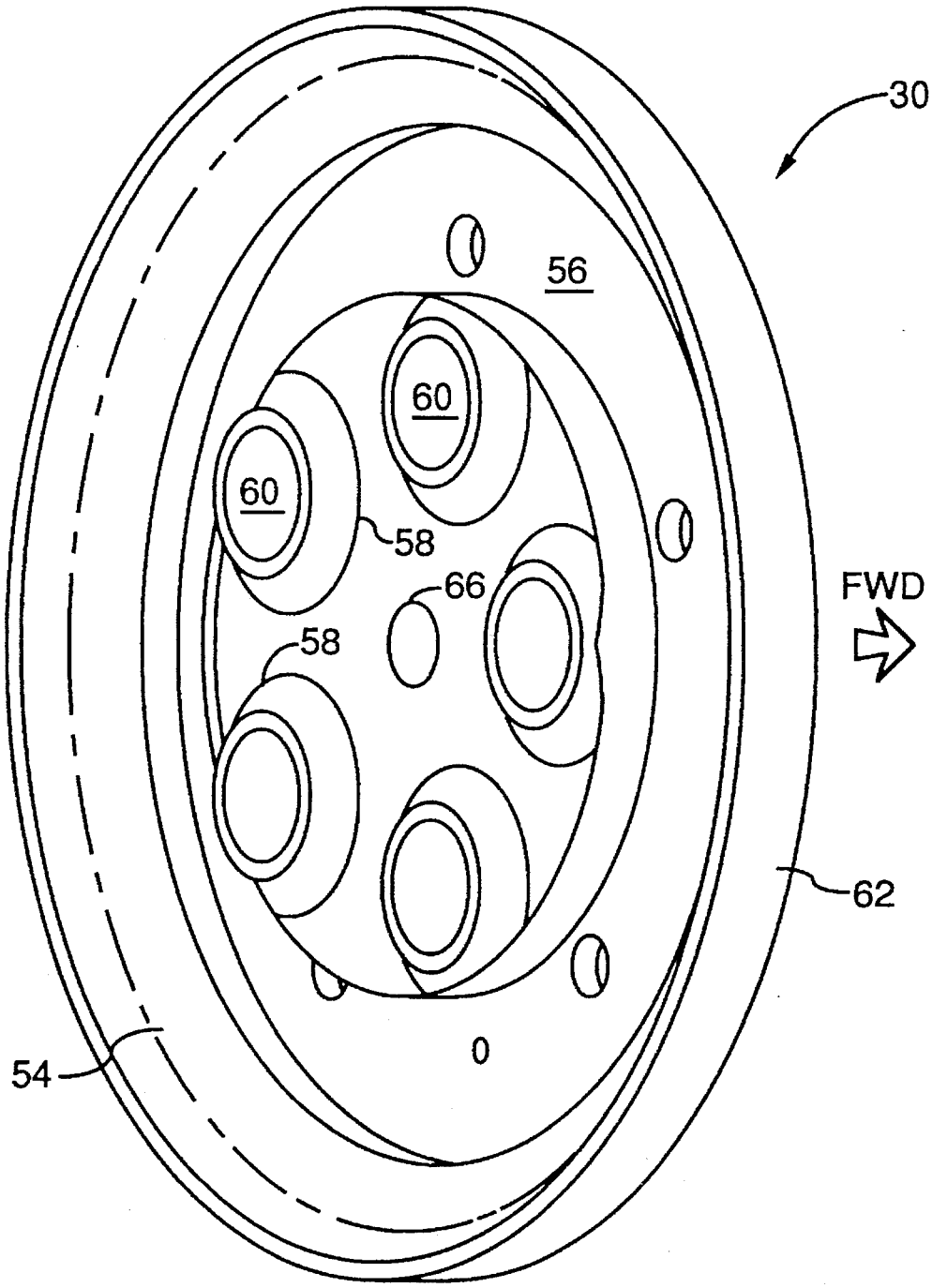
FIG. 7 illustrates by perspective view a baffle plate that connects to the gas diverter.

Referring to FIG. 5, the muzzle clamp 16 is shown in greater detail. The barrels 14, not shown, are inserted through holes 34 of a rear plate 36 and into a forward plate 38. The forward plate 38 has an interface ring 40 and seal groove 42 that fit closely within a muzzle clamp bore 44 of the gas collector 20, FIG. 3, to prevent gases from leaking into the gun compartment. The gas diverter 28, FIG. 6, is bolted onto the face 46 of the muzzle clamp 16. The gas diverter 28 has a first stage radial vane turbine section 48 and a second stage radial vane turbine section 50. The diverter 28 strips the axial-flowing muzzle gases as they leave the barrels 14 and redirect them into radial and tangential flow. While accomplishing this, a forward impulse is produced that cancels a portion of the recoil impulse and a torque is produced that assists run rotation. The baffle plate 30, FIG. 7, is attached directly to the forward face 52 of the gas diverter 28 of FIG. 6. An aft side 54 of the baffle plate 30 contains a deep annular groove 56 to accept the forward end of the gas diverter 28 for bolting thereon. Also attached to the aft side 54 are five raised gas stripping lips 58, one surrounding each projectile port 60 to help divert gas away from the openings. An outer interface 62 of the baffle plate 30 fits closely within a forward bore 64 of the gas collector 20, FIG. 3. A shaft hole 66 in the baffle plate 54 accepts a shaft 68 of the blocking plate assembly 32, FIGS. 8 and 9.

Figure 8:
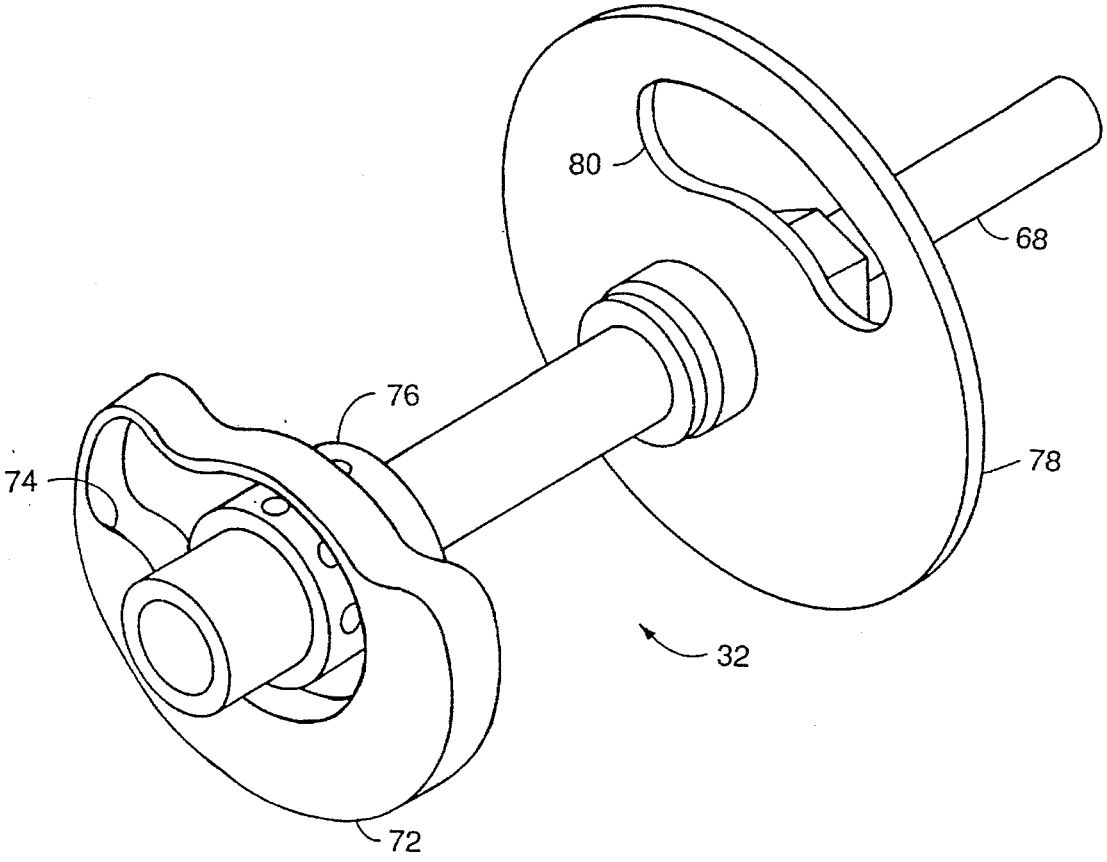
FIG. 8 illustrates by perspective view a blocking plate assembly for use in the gas diverter of FIG. 6.
Figure 9:
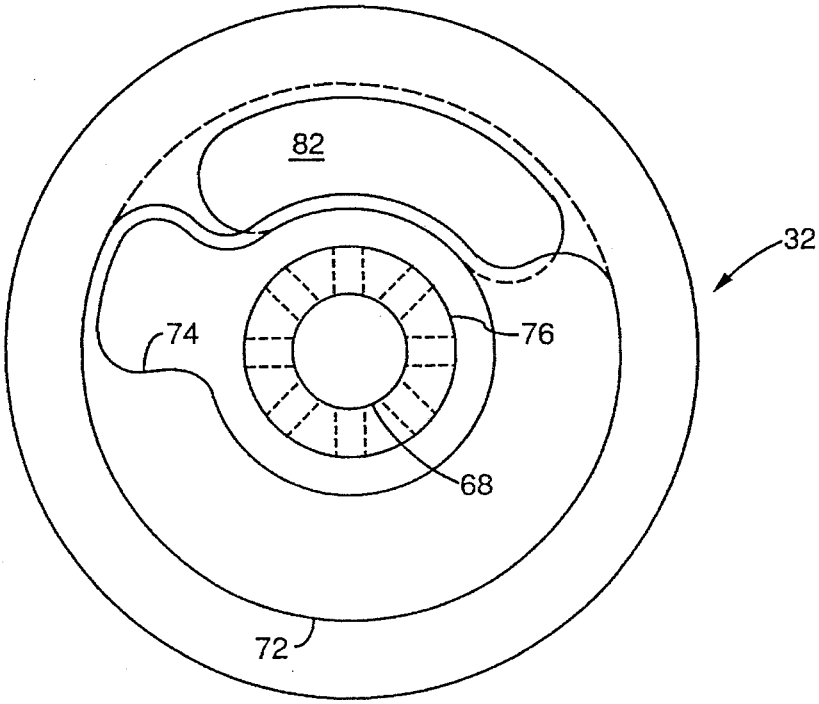
FIG. 9 is a end view of a barrel blocking plate of the blocking plate assembly of FIG. 8.

The shaft 68 is keyed to attach onto the dispersion tube 26 and thus the blocking plate assembly 32 does not rotate within the gas diverter assembly 70, FIG. 4. Because of the gas control system 10, a back pressure is created within the collector 20 which forces gases to flow rearward down the non-firing barrels and into the gun compartment, FIG. 1. In order to reduce this flow channel, the blocking plate assembly 32 is placed within the diverter assembly 70, FIG. 1. In FIG. 8, a barrel blocking plate 72 sweeps the front face 46 of the muzzle clamp 16 and blocks the non-firing barrels from exposure to blast from the firing barrel. A barrel venting cavity 74 is positioned by the keyed shaft 68 to allow the projectile and gas to exit the firing barrel, but as the barrels rotate, that barrel end is blocked off just before the next barrel fires. A venting collar 76 allows the gas to enter and exit into the shaft 68. A forward blocking plate 78 may be attached to the shaft 68 and acts to further restrict the flow of gun gas out of the front of the diverter assembly 70. A peanut-shaped opening 80 is oriented in line with the firing barrel position and is sized to accommodate worst case deviations in the projectile trajectory. The barrel blocking plate 72 has a portion removed to allow for a firing zone 82 from the firing barrel.

The blast deflector 24 and the gas dispersion tube 26 serve to perform both the collector and the duct functions. As the deflected muzzle gases expand through the diverter vanes, they momentarily swirl within the conically shaped collector 20 portion of the blast deflector 24 and then pass through openings 80 in the rear wall of the collector 23 to enter the C-shaped duct 22. The diverted gases then flow down the duct 22 and exhaust from the system in an aftward and upward plume. The blast deflector 24 contains the two functional bores 44 and 64, one interfacing with the muzzle clamp front face, and the other interfacing with the baffle plate. These two bores thus serve to support and stabilize the gun muzzle. Additionally, a piston ring type seal is fitted in a groove 42 between the diverter and the muzzle clamp to minimize the aftward flow of gas into the gun compartment. The gas dispersion tube serves to confine the small percentage of undiverted gases until they reach the fairing surface and can exit harmlessly.

Clearly many modifications and variations of the present invention are possible in light of the above teachings and it is therefore understood, that within the inventive scope of the inventive concept, the invention may be practiced otherwise than specifically claimed.

What is claimed is:

1. A gun gas control system for use on a multi-barrel gatling type gun, said gun gas control system providing torque to rotate the barrels, a recoil counter force, and venting of muzzle gas to a desired location, said gun gas control system comprising:

a gas diverter assembly, said gas diverter assembly connected to a muzzle clamp for holding said barrels of said gatling type gun, said gas diverter assembly providing rotation torque to said barrels and directing muzzle gas in desired directions, said gas diverter assembly comprising:

a gas diverter, said diverter connected to said muzzle clamp, said gas diverter changing the muzzle gas from an axially flowing direction to a radial and tangential directions;

a baffle plate, said baffle plate connected to a front of said gas diverter, said baffle plate restricting the forward flow of muzzle gas, said baffle plate having an exit hole for each barrel of said Gatling type gun; and a blocking plate assembly, said blocking plate assembly being positioned within said gas diverter and said baffle plate, said blocking plate assembly preventing a flow of muzzle gas into non-firing gun barrels of said Gatling type gun, said blocking plate assembly not rotating with said barrels;

means for collecting and routing said muzzle gas from said diverter assembly to said desired locations.

2. A gun gas control system as defined in claim 1 wherein said blocking plate assembly comprises:

a barrel blocking plate, said barrel blocking plate being positioned closely in front of said muzzle clamp, said barrel blocking plate allowing a firing barrel to fire a projectile through a firing zone, said firing zone being a peanut-shaped void, said barrel blocking plate preventing the flow of muzzle gas into non-firing barrels because of the close positioning of said plate to said muzzle clamp; and a shaft, said barrel blocking plate being attached to said shaft, said shaft extending through said baffle plate and being fixedly attached to a non-rotating device of said gas gun control system.

3. A gun gas control system as defined in claim 2 further including a forward blocking plate being attached to said shaft and being positioned inside said gas diverter assembly and being closely positioned behind said baffle plate to prevent muzzle gas from exiting therefrom in an undesired manner, said forward blocking plate having a peanut-shaped void on an outer portion thereof so as to allow the passage of a projectile from a firing barrel.

4. A gun gas control system as defined in claim 2 further having a barrel venting cavity in said barrel blocking plate, said barrel venting cavity being in a position of a last fired barrel so as to allow venting of residue muzzle gas therefrom.

5. A gun gas control system as defined in claim 4 further including a path for venting said residue muzzle gas, said path being at least one channel in said shaft.

* * * * *